US005666595A

United States Patent [19]

Sameshima et al.

[11] Patent Number: 5,666,595

[45] Date of Patent: Sep. 9, 1997

[54] IMAGE FORMING APPARATUS WITH LOCKING MECHANISM FOR DETACHABLE FEEDER UNIT

[75] Inventors: Takao Sameshima, Yokosuka; Yutaka Kikuchi; Kazuaki Takahashi, both of Kawasaki, all of Japan

[73] Assignee: Canon Kabushiki Kaisha, Tokyo, Japan

[21] Appl. No.: 532,511

[22] Filed: Sep. 22, 1995

[30] Foreign Application Priority Data

Oct. 3, 1994 [JP] Japan ..... 6-238812
May 22, 1995 [JP] Japan ..... 7-122321

[51] Int. Cl.[6] ..... G03G 15/00

[52] U.S. Cl. ..... 399/110; 24/658; 271/145; 399/391; 399/393

[58] Field of Search ..... 355/200, 308, 355/309; 347/138, 152; 271/145; 70/58; 292/302; 312/108, 111, 263; 24/458, 658, 656, 701; 399/110, 391, 393

[56] References Cited

U.S. PATENT DOCUMENTS 1,511,900 10/1924 Mandis ..... 24/658
2,822,198 2/1958 Priestman ..... 24/458
3,619,050 11/1971 Swanke ..... 355/212
4,796,035 1/1989 Kawasaki et al. ..... 347/262
4,801,981 1/1989 Chikano et la. ..... 355/308
5,002,266 3/1991 Kikuchi et al. ..... 271/3.2
5,049,946 9/1991 Harada ..... 355/309
5,191,382 3/1993 Okamura et al. ..... 355/309
5,201,873 4/1993 Kikuchi et al. ..... 271/9.13
5,240,238 8/1993 Lee ..... 271/145 X
5,270,772 12/1993 Akiyama ..... 355/200
5,276,489 1/1994 Kikuchi et al. ..... 355/274
5,290,024 3/1994 Takahashi ..... 271/122
5,292,116 3/1994 Inoue et al. ..... 271/157
5,377,970 1/1995 Kikuchi ..... 271/121
5,420,762 5/1995 Lewis ..... 24/701 X
5,465,141 11/1995 Asano et al. ..... 355/285
5,474,287 12/1995 Takahashi ..... 271/10.13

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image forming apparatus has an apparatus body and an optional cassette feeder unit which is detachably mounted on the apparatus body. The optional cassette feeder unit stores sheets and feeds sheets to the image forming section of the body. The image forming apparatus is provided with locking sections which engage with leg sections provided at the lower surface of the apparatus body in order to connect the body to the optional cassette feeder unit.

14 Claims, 12 Drawing Sheets

IMAGE FORMING APPARATUS WITH LOCKING MECHANISM FOR DETACHABLE FEEDER UNIT

BACKGROUND OF THE INVENTION

1. Field of the Invention

The present invention relates to an image forming apparatus, such as a laser beam printer, a copying machine, and a facsimile machine, and an optional cassette feeder unit provided therebelow.

2. Description of the Related Art

A conventional image forming apparatus will be described using a black and white laser beam printer shown in FIG. 10. The body 52 of the laser beam printer 51 is provided with a cassette feeder 53 integral therewith and serving as a sheet-supply section under the body in FIG. 10. Under the cassette feeders 53, an optional cassette feeder unit 54 is provided. This optional cassette feeder unit 54 is a unit separate from the body 52. The body 52 is positioned and mounted on the optional cassette feeder unit to thereby build the laser beam printer 51.

At the lower part of the laser beam printer 51 on the front surface (right-hand side in FIG. 10), two cassette insertion slots 52*a* and 54*a* are formed. Universal cassettes 55 and 56 serving as sheet carrying units can be mounted in the direction indicated by arrows in the figure. Sheets P loaded and stored in the universal cassettes 55 and 56 are fed to a stopping register roller pair 59 by sheet feeding rollers 57 and 58, serving as sheet feeding means.

Luminous flux 61 emitted from a laser oscillating unit 60 according to image information is reflected by a mirror 62 and forms an image on a photosensitive drum 64 provided for a process cartridge 63. The photosensitive drum 64 rotates at a constant speed. A sheet P is carried by the register roller pair 59 at a certain timing to a position between the photosensitive drum 64 and a transfer roller 66 such that a latent image formed on photosensitive drum 64 at point A is developed with toner 65 from developing unit in the process cartridge 63 and the developed latent image is transferred to the sheet P at point B.

After image transfer, the sheet P on which the non-fixed toner image is placed is nipped by a fixing roller pair 67. Heat and pressure are applied to the non-fixed toner image and it is fixed. The sheet P is then discharged to the outside of the apparatus with the image surface facing upward by a convey roller pair 68 and a face-up discharging roller pair 69. Alternatively, the sheet P is discharged at the upper section of the apparatus with the image surface facing downward by the convey roller pairs 68 and 70, and a face-down discharging roller pair 71.

The optional cassette feeder unit 54 is provided with the optional universal cassette 56 and the sheet-feeding roller 58 for feeding and conveying the sheet P.

As shown in FIG. 11, on the upper surface of the optional cassette feeder unit 54 positioning pins 54*a*, 54*b*, and 54*c* and a floating connector (male) 72 are provided. At the bottom of the cassette feeder 53, which is combined together with the body 52, are provided positioning holes 53*a* (round hole), 53*b* (oblong hole), and 53*c* (round hole) which fit with the positioning pins 54*a*, 54*b*, and 54*c*, respectively, and a floating connector (female) 73 which connects with the floating connector (male) 72.

Rubber- or resin-made legs 74 are provided at the bottom of the cassette feeder 53. An extension path 75 is formed in the cassette feeder 53 for conveying the sheet P sent from the optional cassette feeder unit 54, as shown in FIG. 10.

Generally, either of the floating connectors 72 and 73 can freely move on a plane within a range of several millimeters. A connection portion is provided with a taper serving as a guide. To assure positioning precision between the body 52 and the optional cassette feeder unit 54, the positioning pins 54*a* and 54*b* and the positioning holes 53*a* and 53*b* are configured with relatively high fitting precision.

To connect the body 52 to the optional cassette feeder unit 54, the positioning pins 54*a* and 54*b* are first fit in the positioning holes 53*a* and 53*b* before the floating connectors 72 and 73 connect. The body 52 and the optional cassette feeder unit 54 may connect in the state in which a part of the bottom surface of the cassette feeder 53 near the floating connector 73 butted up against the upper surface of the floating connecter 72. In this case, the floating connectors 72 and 73 do not connect and an electrical signal from the body 52 is not transmitted to the optional cassette feeder unit 54, causing malfunction.

To prevent this problem from occurring, the positioning pins 54*a* and 54*b* are made relatively high in order to positively connect the floating connectors 72 and 73 with the positioning pins 54*a* and 54*b* being fit in the positioning holes 53*a* and 53*b*. In addition, the positioning pin 54*c* and the positioning hole 53*c* are provided near the floating connectors 72 and 73 for facilitating the connection between the connectors 72 and 73. Since the positioning pins 54*c* and the positioning hole 53*c* are configured such that they have certain margins in fitting dimensions, the body 52 can be moved slightly against the optional cassette feeder unit 54. This facilitates the connection between the floating connectors 72 and 73, allowing the height of the positioning pins 54*a* and 54*b* to be lowered to some extent.

The movement of the sheet P supplied from the optional cassette feeder unit 54 will be described below. The sheet P loaded on the cassette 56 is taken out by the sheet feeding roller 58 and is conveyed to the register roller pair 59 through the extension path 75 in the cassette feeder 53 of the body 52. At the bottom of the body 52, which connects to the extension path 75, a communication slot 76 is formed. The sheet P passes through the communication slot 76.

A locking mechanism is provided for preventing the body 52 and the optional cassette feeder unit 54 from separating or shifting relative to each other after the body 52 is mounted on the optional cassette feeder unit 54. The locking mechanism locks the connection between the body 52 and the optional cassette feeder unit 54 by engaging a locking lever 78 provided on the upper surface of the optional cassette feeder unit 54 with a securing pin 77 provided at the bottom of the cassette feeder 53. At a side of the optional cassette feeder unit 54, a locking release lever 79 is provided for releasing the engagement of the locking lever 78 against the securing pin 77 by rotating the locking lever 78 out of engagement with pin 77.

FIG. 12(*a*) shows the condition of the locking mechanism immediately before the body 52 is mounted on the optional cassette feeder unit 54. FIG. 12(*b*) illustrates the condition of the locking mechanism after the body is mounted on the optional cassette feeder unit 54. The locking lever 78 is mounted such that it can be rotated about a rotation shaft 78*a* and abuts against stopper 81 by the force from pulling spring 80.

When the body 52 is lowered after being positioned with the positioning pins 54*a* and 54*b*, the securing pin 77 of the body 52 pushes the taper portion 78*b* of the locking lever 78 in the optional cassette feeder unit 54 to rotate the locking lever 78 about the rotation shaft 78*a* clockwise as shown in FIG. 12(*b*). When the body has been mounted on the optional cassette feeder unit, the locking lever returns to the position indicated with the dotted line having two short dashes and engages with the securing pin 77, completing the connection. To release locking, the locking release lever 79, which is secured to the rotation shaft 78*a*, is rotated such that the locking lever 78 is rotated clockwise against the force caused by the pulling spring 80.

The conventional image forming apparatus, however, has the following problems. Since the securing pin 77 and the locking lever 78, which are part of the locking mechanism, are provided inside the body 52 or the optional cassette feeder unit 54, it is necessary to allocate space for them, thereby restricting the compactness of the apparatus.

Since the locking lever 78 is rotated and engaged with the securing pin 77, the locking mechanism is complicated, requiring relatively high machining precision for its members. This also requires relatively high precision in assembly, making the apparatus expensive.

To add the optional cassette feeder unit 54 to the body 52, the positioning pins 54*a* and 54*b* provided on the upper surface of the optional cassette feeder unit 54 are aligned with the positioning holes 53*a* and 53*b* provided at the bottom of the cassette feeder 53 combined with the body, the body 52 is placed on the optional cassette feeder unit 54, and then the floating connectors 72 and 73 provided for the body 52 and the optional cassette feeder unit 54 are connected. This configuration requires that the positioning pins 54*a* and 54*b* be long or the positioning pin 54*c* and the positioning hole 53*c* be provided near the floating connectors 72 and 73 for facilitating the connection between the connectors 72 and 73.

When the positioning pins 54*a* and 54*b* are made long, if the body is relatively light, for example, about 20 kg or less, it is easy to fit the body 52 in the optional cassette feeder unit 54. If the body 52 is relatively heavy, such as that requiring two persons to carry it, it is difficult to fit the body 52 in the optional cassette feeder unit 54. The positioning pins 54*a* and 54*b* may hit the body 52 during the fitting. The body may hit the floating connector 72, which protrudes from the optional cassette feeder unit 54, breaking the connector 72.

SUMMARY OF THE INVENTION

Accordingly, it is an object of the present invention to solve the technical problems described above. Another object of the present invention is to provide an image forming apparatus which facilitates the addition of an optional feeder to the body.

The above objects of the present invention are achieved through the provision of an image forming apparatus provided with a detachable feeder unit for storing and feeding sheets to be supplied to image forming means in the image forming apparatus body, wherein locking means is provided for connecting the apparatus body to the feeder unit.

The locking means may be configured such that it comprises horizontally extending grooves formed on the leg sections and locking plates movably provided on the feeder unit, and whereby the locking plates move and fit into the grooves on the leg sections for connecting the apparatus body to the feeder unit.

The locking plates may be configured such that they comprise guide holes having a diameter larger than the outside diameter of the leg sections and into which the leg sections can be inserted, and locking holes formed in connection with the guide holes and having a width which allows the grooves formed on the leg sections to engage with the locking holes, and the apparatus body is connected to the feeder unit by moving the locking plates to engage the grooves of the leg sections with the locking holes in order to engage the leg sections with the locking plates after the leg sections are inserted into the guide holes.

The image forming apparatus may be configured such that engagement members which engage with the leg sections of the apparatus body are provided for the feeder unit for positioning the apparatus body against the feeder unit, and the locking means comprise through holes passing through the leg sections and the positioning members, and securing pins to be fit in the through holes.

The securing pins may be configured such that they are prevented from coming off from the leg sections with a snap-fitting mechanism. The image forming apparatus may further comprise rotation-preventing means for preventing the securing pins from rotating in the through holes.

The image forming apparatus may be configured such that the engagement members are positioning pins which can fit in positioning holes formed at the bottom surface of the leg sections, and the positioning holes are formed so that the positioning pins fit in the positioning holes at the bottom side of the leg sections and the positioning pins are set free at the inside of the leg sections.

Floating connectors may be provided for transferring electrical signals between the apparatus body and the feeder unit. The floating connectors may be disposed between the bottom surface of the leg sections of the apparatus body and the upper surface of the feeder unit.

With the configuration described above, the apparatus body can be connected to the optional feeder by engaging the locking means with the leg sections provided at the lower surface of the apparatus body.

When the locking means comprise locking plates movably provided at the optional feeder, the apparatus body can be connected to the optional feeder by moving the locking plates and fitting them in the grooves of the leg sections provided at the lower surface of the apparatus body.

When the engagement members which engage with the leg sections provided at the lower surface of the apparatus body are provided at the upper surface of the optional feeder, and the locking means comprise the through holes passing through the leg sections and the engagement members and the securing pins to be fit in the through holes, the apparatus body can be connected to the optional feeder by fitting the securing pins through the through holes.

When the securing pins are configured such that they engage with the leg sections with a snap-fitting mechanism, the securing pins can be prevented from coming off. The rotation-preventing means prevents the securing pins from rotating in the through holes.

BRIEF DESCRIPTION OF THE DRAWINGS

FIG. 3(*b*) is an enlarged cross section showing the locking structure after the apparatus body has been mounted to the optional cassette feeder unit in the first embodiment.

DETAILED DESCRIPTION OF THE PREFERRED EMBODIMENT

Figure 1:
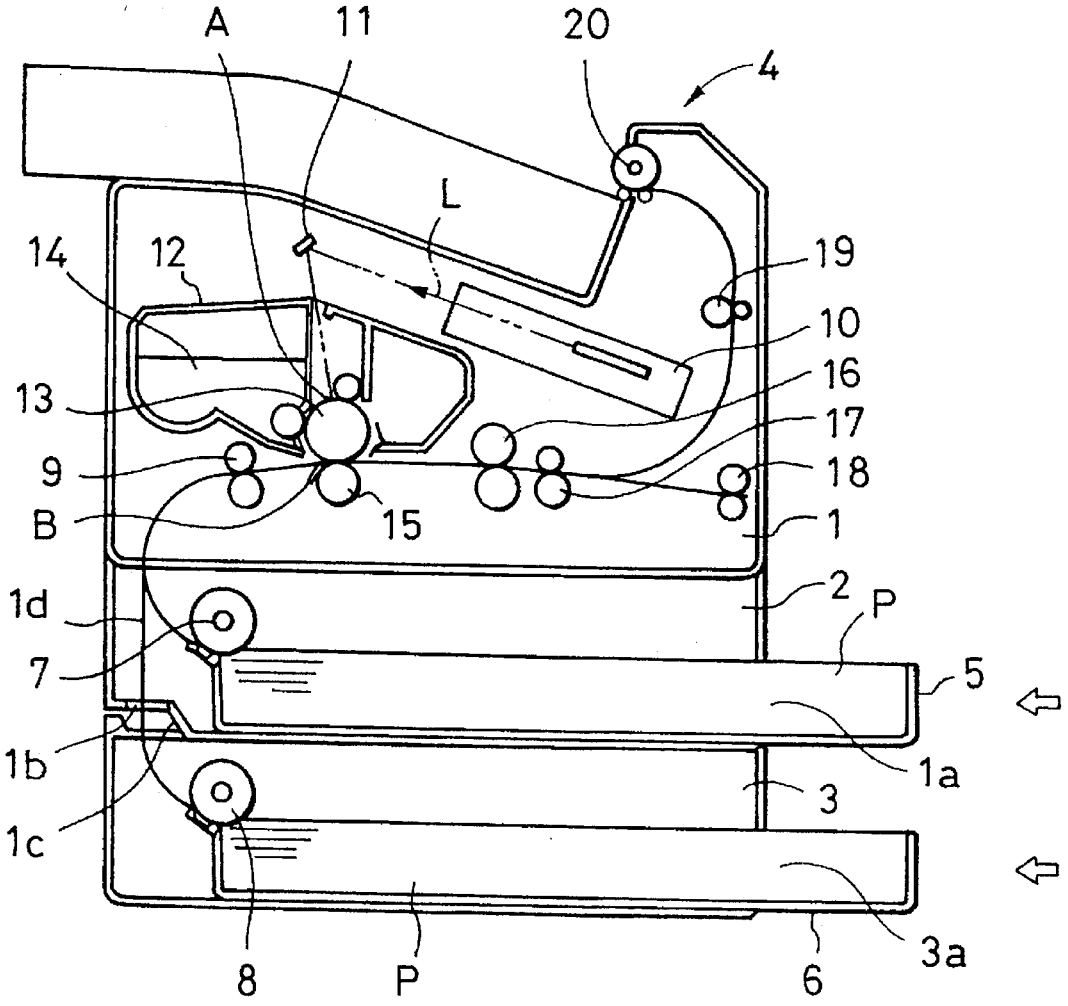
FIG. 1 is a cross section showing overall configuration of a laser beam printer
Figure 2:
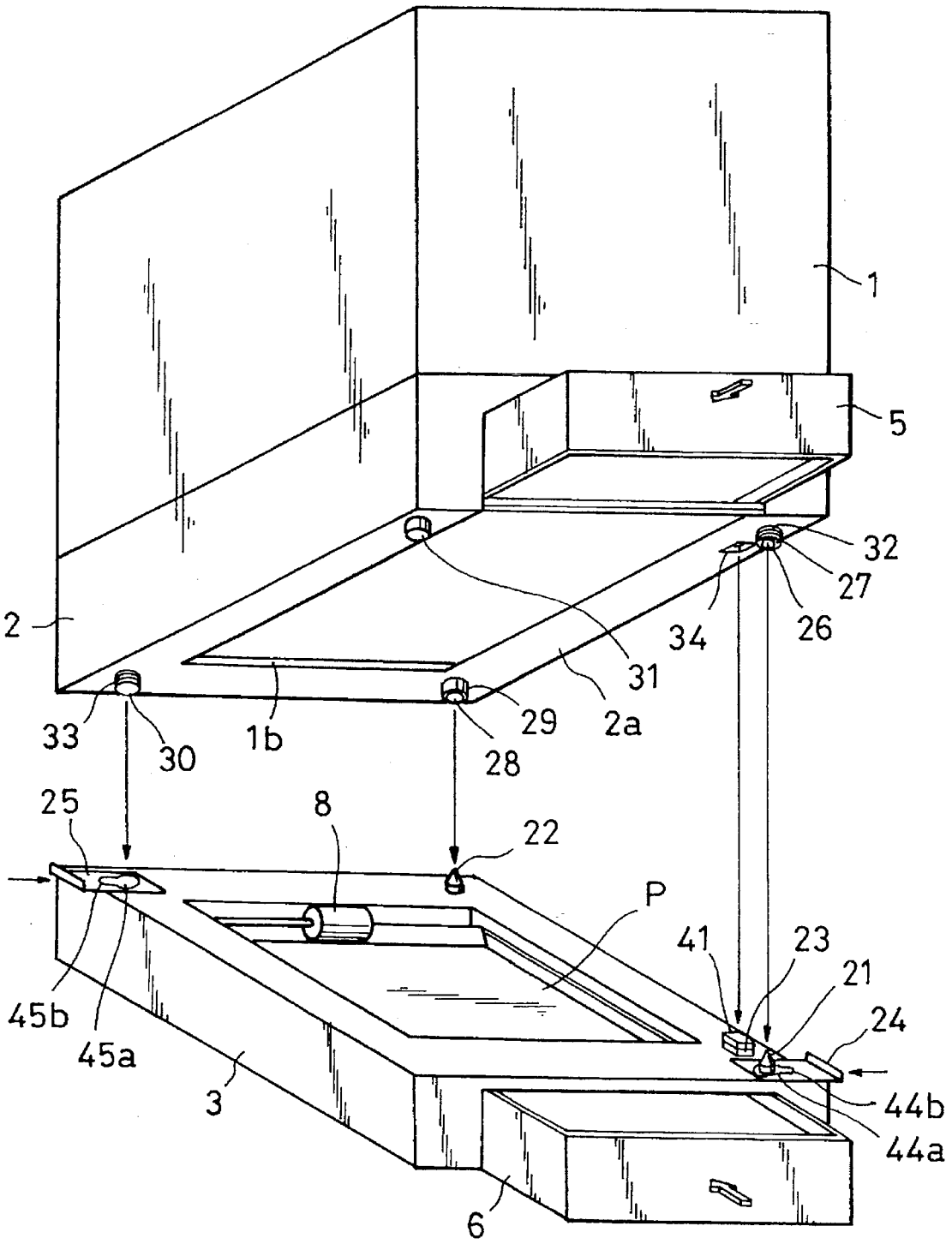
FIG. 2 is a perspective view illustrating the structure connecting an optional cassette feeder unit to the body of an image forming apparatus according to a first embodiment.
Figure 3A:
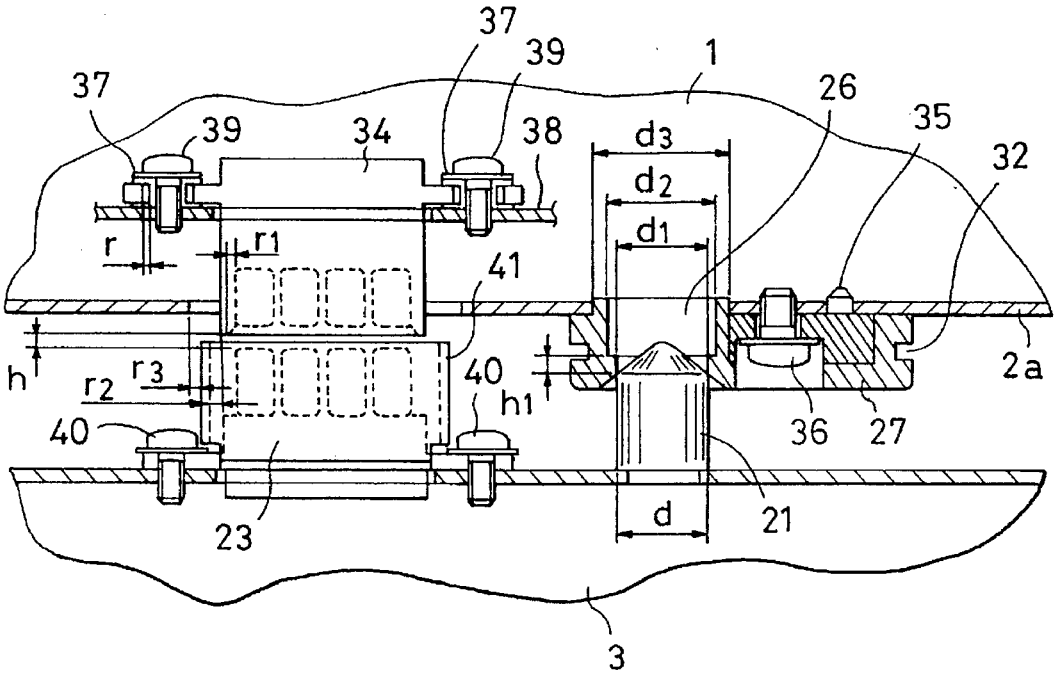
FIG. 3(*a*) is an enlarged cross section showing the locking structure before the apparatus body is mounted to the optional cassette feeder unit in the first embodiment.
Figure 3B:
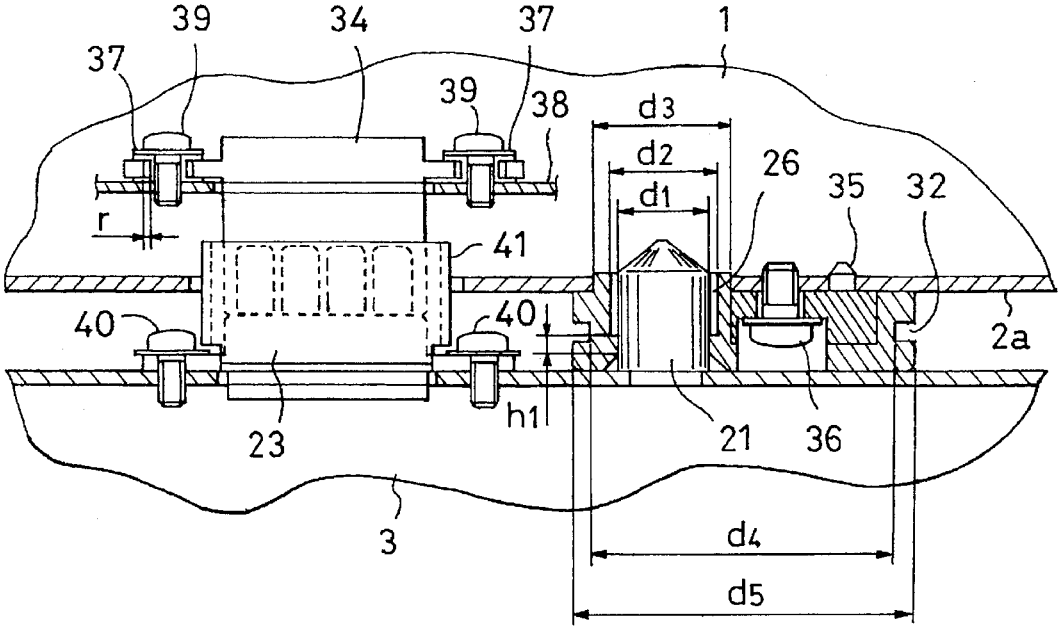
Figure 4A:
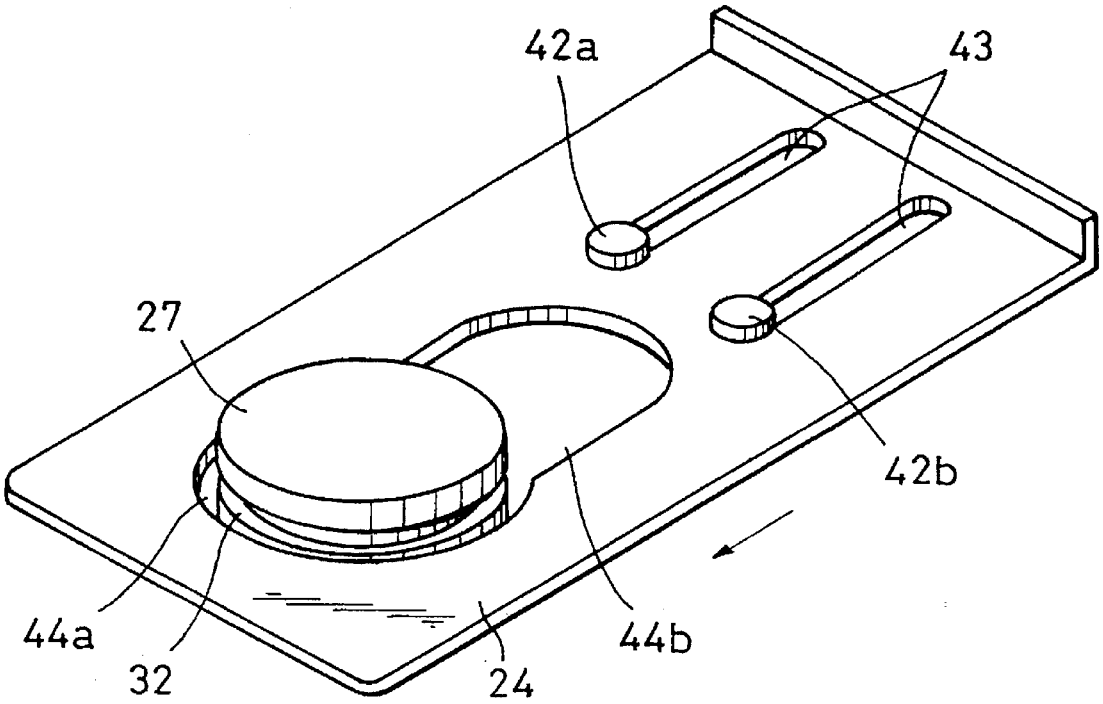
FIGS. 4(*a*) and 4(*b*) are an enlarged perspective view and planar view, respectively, of the configuration of a section connecting a horizontal slide locking plate and a leg section.
Figure 4B:
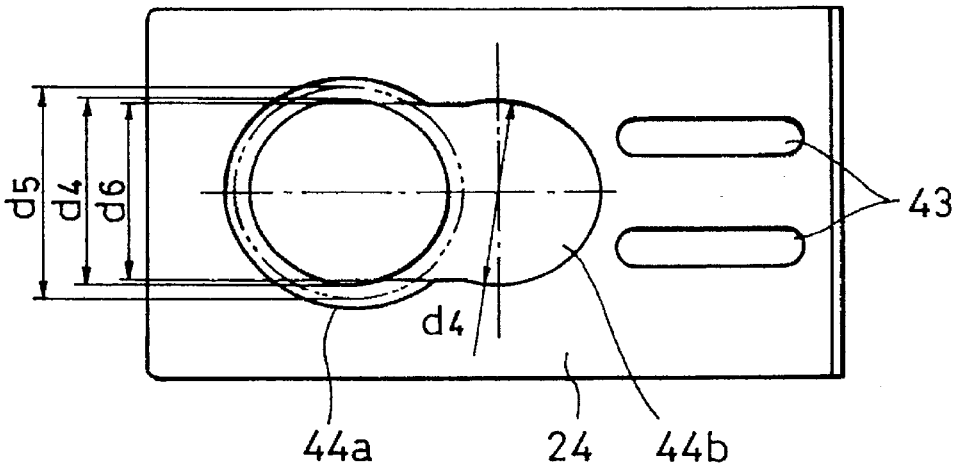

Embodiments of the image forming apparatus according to the present invention will be described below by referring to the drawings. In these embodiments, a laser beam printer is used as an image forming apparatus and the laser beam printer is mounted on an optional cassette feeder unit. FIG. 1 is a cross section illustrating overall configuration of such a laser beam printer. FIG. 2 is a view showing a connection structure between an optional cassette feeder unit and the body of an apparatus according to a first embodiment. FIG. 3(*a*) is an enlarged view of the main section of the body of the apparatus according to the first embodiment before the body is mounted on the optional cassette feeder unit. FIG. 3(*b*) is an enlarged view of the main section of the body of the apparatus according to the first embodiment after the body is mounted on the optional cassette feeder unit. FIGS. 4(*a*) and 4(*b*) are enlarged views of the configuration of a connection section of a horizontal slide locking plate and a leg section.

By referring to FIG. 1, an outline configuration of the laser beam printer will be described. In FIG. 1, a cassette feeder 2 serving as a sheet feeding section is contained in a lower portion of the body 1 of the laser beam printer apparatus. Below the cassette feeder 2, the optional cassette feeder unit 3 is provided. The optional cassette feeder unit 3 is a unit separate from the body 1. The laser beam printer 4 is configured by positioning the body 1 and mounting it on the optional cassette feeder unit.

The laser beam printer 4 has cassette insertion slots 1*a* and 3*a* at the lower part on the front-end surface (right-end surface in FIG. 1). Universal cassettes 5 and 6 serving as sheet carrying units can be inserted into the slots in the direction indicated by the arrows in FIG. 1 and taken out of the slots in the opposite direction. Sheets made of paper or synthetic resin are loaded and stored in the universal cassettes 5 and 6. A sheet P is fed from one of cassettes 5 and 6 by rotation of feeding rollers 7 and 8, respectively, each serving as feeding means, and is conveyed to a still register roller pair 9.

Luminous flux L emitted from a laser oscillating unit 10 according to image information is reflected by a mirror 11 and forms an image on an electrophotosensitive member 13 mounted to a process cartridge 12 serving as image forming means. The photosensitive drum 13 rotates at a constant speed. The register roller pair 9 conveys the sheet P to between the photosensitive drum 13 and a transfer roller 15 at an appropriate timing such that a latent image formed by the reflected light at point A is developed with toner 14 in the process cartridge 12 and the developed image is transferred to the sheet P at point B.

After image transfer, the sheet P on which the non-fixed toner image is placed is clamped by a fixing roller pair 16. Heat and pressure are applied to the non-fixed toner image and it is fixed. The sheet P is then discharged to the outside of the apparatus with the image surface facing upward by a convey roller pair 17 and a face-up discharging roller pair 18. Alternatively, the sheet P is discharged at the upper section of the apparatus with the image surface facing downward by the convey roller pairs 17 and 19 and a face-down discharging roller pair 20.

The optional cassette feeder unit 3 is provided with the optional universal cassette 6 and the feeding roller 8 for feeding and conveying the sheet P. When the sheet P is fed from the optional universal cassette 6 by the feeding roller 8, it is conveyed through a communication slot 1*b* of the body 1 to an extension path 1*d* to the register roller pair 9, and the image forming operation described above is performed.

An angled section 1*c* serving as a sheet guide is provided near the communication slot 1*b*. With this angled section 1*c*, when a sheet is deformed, especially when a sheet waves substantially under a high-temperature, high-humidity environment, the tip of the sheet can be positively guided to the communication slot 1*b*.

In FIG. 2, on the upper surface of the optional cassette feeder unit 3, upwardly protruding positioning pins 21 and 22, serve as engagement members for engaging with legs 27 and 29 (described later), provided on the lower surface of the body 1 for use in positioning between the body 1 and the optical cassette feeder unit 3. A floating connector (male) 23 is provided near the positioning pin 21. Around the positioning pin 21, a horizontal slide locking plate 24 serving as locking means is provided. Also at the diagonal position against the horizontal slide locking plate 24 on the upper surface of the optional cassette feeder unit 3, a horizontal slide locking plate 25 also serving as locking means is provided.

Provided the four corners of the bottom of the cassette feeder 2 formed as a unit with the body 1 is the leg 27 on which a positioning hole 26 (round hole) is formed for fitting with the positioning pin 21 of the optional cassette feeder unit 3, the leg 29 on which a positioning hole 28 (oblong hole) is formed for fitting with the positioning pin 22 of the optional cassette feeder unit 3, a leg 30 engaging with the horizontal slide locking plate 25, and a leg 31 abutting the upper surface of the optional cassette feeder unit 3. As shown in FIG. 4 in detail, the leg 27 has groove 32 into which the horizontal slide locking plate 24 fits by sliding. Similarly, leg 30 has groove 33 into which the horizontal slide locking plate 25 fits by sliding.

Adjacent to the leg 27, a floating connector (female) 34 is provided.

FIGS. 3(*a*) and 3(*b*) show the enlarged main section around the positioning pin 21 and the floating connector 23. FIG. 3(*a*) illustrates the condition immediately before the body 1 is mounted on the optional cassette feeder unit 3 and FIG. 3(*b*) shows the condition after mounting.

The leg 27 protruded from the bottom surface 2*a* of the cassette feeder 2 is molded resin or elastomer. The leg 27 is fit-positioned with a boss 35 and the outside diameter $d_3$ of the positioning hole 26 and is secured with a machine screw 36. The positioning hole 26 comprises a section into which the positioning pin 21 of the optional cassette feeder unit 3 fits and which has a diameter of $d_1$, and a section having a diameter of $d_2$ for free fit. The section having a diameter of $d_2$ may be a tapered surface.

A groove 32 for slide locking is formed on the leg 27. The floating connector (female) 34 provided on the body 1 is secured to a bracket 38 with machine screws 39 through collars 37. The floating connector 34 can move on the bracket 38 at a distance equal to the radius difference r. A taper (whose length is $r_1$) is formed at the connection opening section of the floating connector (female) 34 in order to guide the male connector 23.

The floating connector (male) 23 provided on the optional cassette feeder unit 3 is secured with machine screws 40. Around the connector 23, a connector protecting plate 41 which has a height equal to or greater than that of the protrusion of the floating connector 23 is provided.

The diameter d of the positioning pin 21, the diameter $d_1$ of positioning hole 26, the radius difference $r_2$ between the floating connectors 23 and 34, and the clearance $r_3$ between the connector protecting plate 41 and the bottom section 2*a* have the relationship described below.

$$(d_1-d)/2+r<r_1 \quad (1)$$

$$(d_1-d)/2<r_3 \quad (2)$$

$$r_2>r_1 \quad (3)$$

As shown in FIG. 3(*a*), a clearance having a height of h is provided at the position parallel to where the positioning pin 21 starts fitting in order to arrange the positional matching of the floating connectors 23 and 34 beforehand. The height $h_1$ of the fitting hole section having a diameter of $d_1$ in the positioning hole 26 is set to about 1 to 3 mm and the fitting section provides a loose fitting with a gap of about 0.1 to 0.3 mm ($=d_1-d$). Therefore, if the body 1 is mounted on or removed from the optional cassette feeder unit 3 with the body being slanted, the positioning pin 21 and the positioning hole 26 do not catch.

FIG. 4(*a*) shows an enlarged perspective view of a horizontal slide locking mechanism. FIG. 4(*b*) illustrates the plan view of the mechanism. Since a horizontal slide locking plate 25 has the same configuration as a horizontal slide locking plate 24, only the horizontal slide locking plate 24 will be described here. The plate 24, provided on the upper part of the optional cassette feeder unit 3, is secured to the optional cassette feeder unit 3 with securing pins 42*a* and 42*b* so that the plate does not come off. The plate 24 can slide along slide grooves 43.

The slide locking plates 24 and 25 have guide holes 44*a* and 45*a* with a diameter slightly larger than the outside diameter $d_5$ of the legs 27 and 30. Locking holes 44*b* and 45*b* link with the guide holes and have a width adequate to fit the grooves 32 and 33 with a diameter of $d_4$ in the legs 27 and 30. When the slide locking plates 24 and 25 are slid in the direction indicated by the arrows in FIG. 2 respectively, the locking holes 44*b* and 45*b* fit with the grooves 32 and 33 of the legs 27 and 30, locking the body 1 and the optional cassette feeder unit 3.

Narrowing the inlet-portion's width $d_6$ of the locking holes 44*b* and 45*b* to slightly less than the diameter $d_4$ causes the slide locking plates 24 and 25 to click when they are locked or unlocked. In this embodiment, the locking plates 24 and 25 slide. They may rotate about fulcrums provided on the optional cassette feeder unit 3.

According to the configuration described above, the legs 27 and 29 provided at the bottom of the body 1 have the positioning holes 26 and 28 which fit with the positioning pins 21 and 22 provided on the optional cassette feeder unit 3. This allows the protrusion of the positioning pins provided on the optional cassette feeder unit and that of the floating connectors to be reduced.

Rough positioning can be done with use of the legs 27 and 29 when the body 1 is mounted on the cassette feeder unit 3. This facilitates the mounting without the positioning pins 21 and 22 and the floating connector 23 hitting other members.

Since the positioning holes 26 and 28 fit with the positioning pins 21 and 22 at the leg bottom portion and leave space for them at the leg top portion, the positioning pins 21 and 22 do not snag when entering the positioning holes 26 and 28 even if the body 1 is mounted on or removed from the optional cassette feeder unit 3 while the body 1 is at an angle relative to the optional cassette feeder unit 3. This facilitates mounting and removing of the body 1 on and from the optional cassette feeder unit 3.

The slide locking plates 24 and 25 on the upper surface of the optional cassette feeder unit 3 slide and fit in the grooves 32 and 33 formed at the legs 27 and 30, thereby providing a locking mechanism in a narrow space with low cost.

Next, a second embodiment of the image forming apparatus according to the present invention will be described by referring to FIGS. 5 to 8. Since the basic configuration of a laser beam printer and locking mechanism is the same as for the first embodiment, the same members are assigned the same numbers and their descriptions are omitted here. The main portion will chiefly be described.

Figure 5:
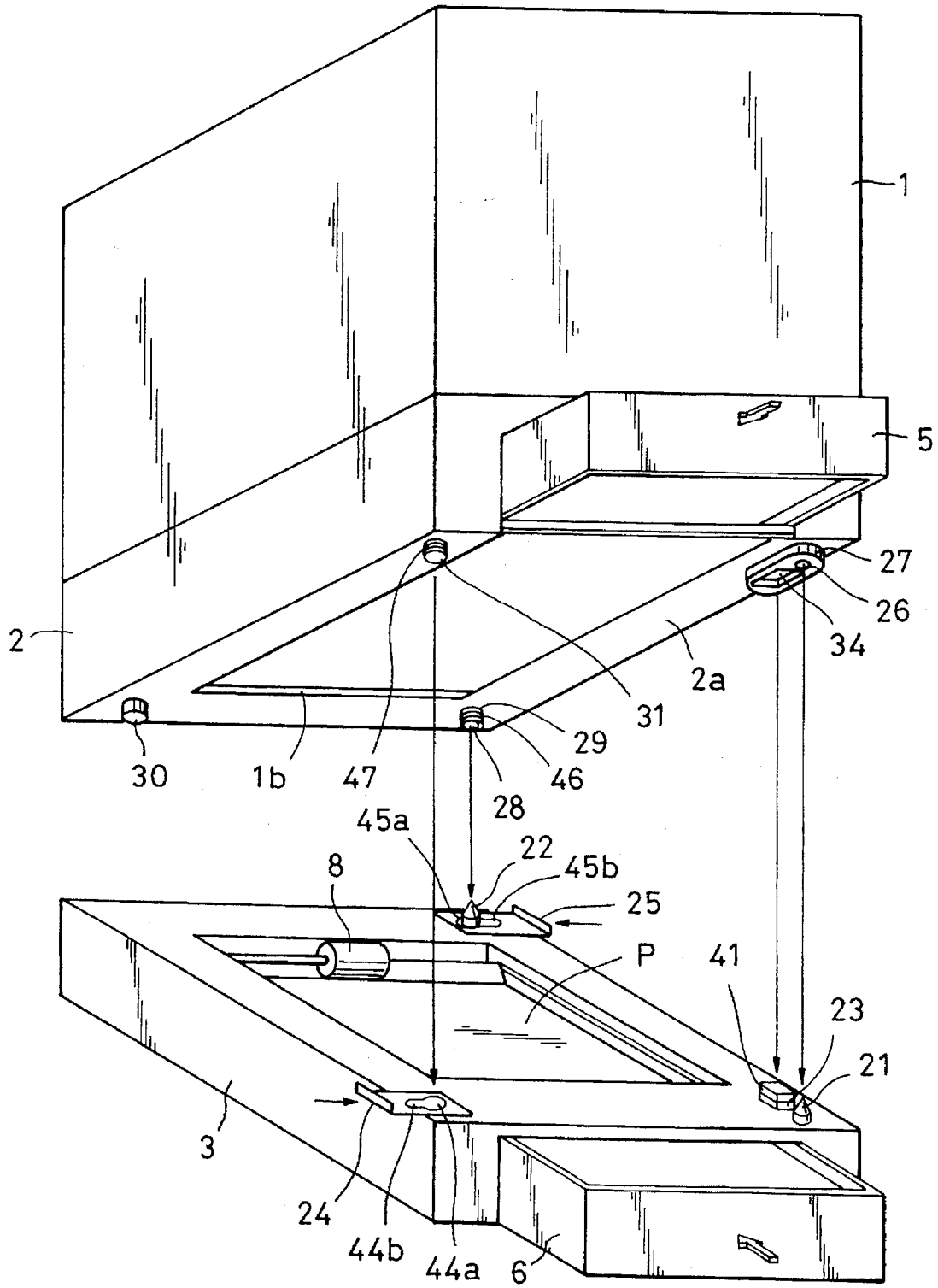
FIG. 5 is a perspective view illustrating the structure connecting an optional cassette feeder unit to the body of an image forming apparatus according to a second embodiment.
Figure 6A:
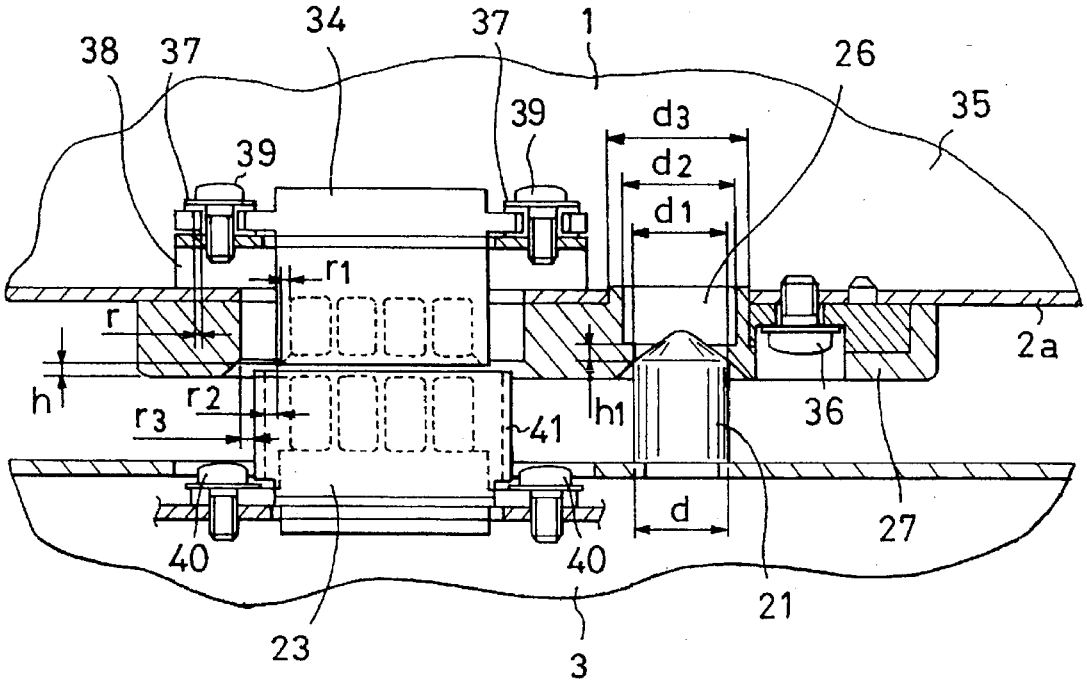
FIGS. 6(*a*) and 6(*b*) are enlarged views showing, respectively, the conditions before and after the apparatus body according to the second embodiment is mounted to the optional cassette feeder unit.
Figure 6B:
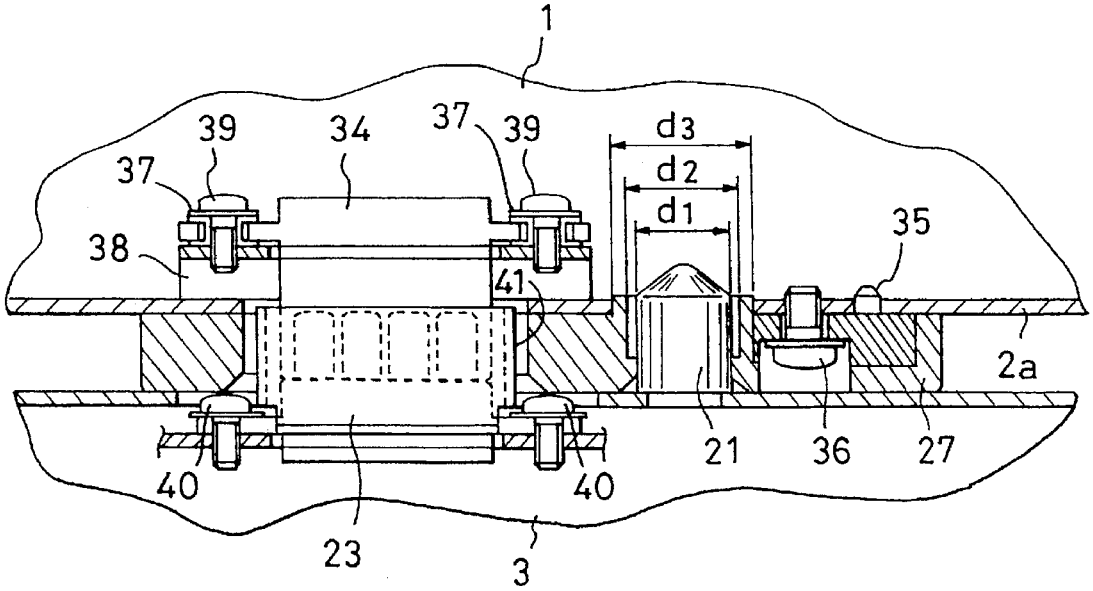

In FIGS. 5 and 6, a floating connector (female) 34 as well as a positioning hole 26 is provided at the bottom of a leg 27 made of resin or elastomer in the body 1. On the upper surface of an optional cassette feeder unit 3, the slide locking plates 24 and 25 are provided at the diagonal corners opposite to those where the plates are positioned in the first embodiment shown in FIG. 2. Legs 29 and 31 which are positioned with the slide locking plates 24 and 25 have grooves 46 and 47 in the outside surfaces in the same way as in the first embodiment. A floating connector (male) 23 has a connector protecting plate 41 at its outside. Other configurations are the same as in the first embodiment. With these configurations, the second embodiment has the same advantages as the first embodiment.

The leg 27 may have the positioning hole 26 and the floating connector 34 within it.

Figure 7:
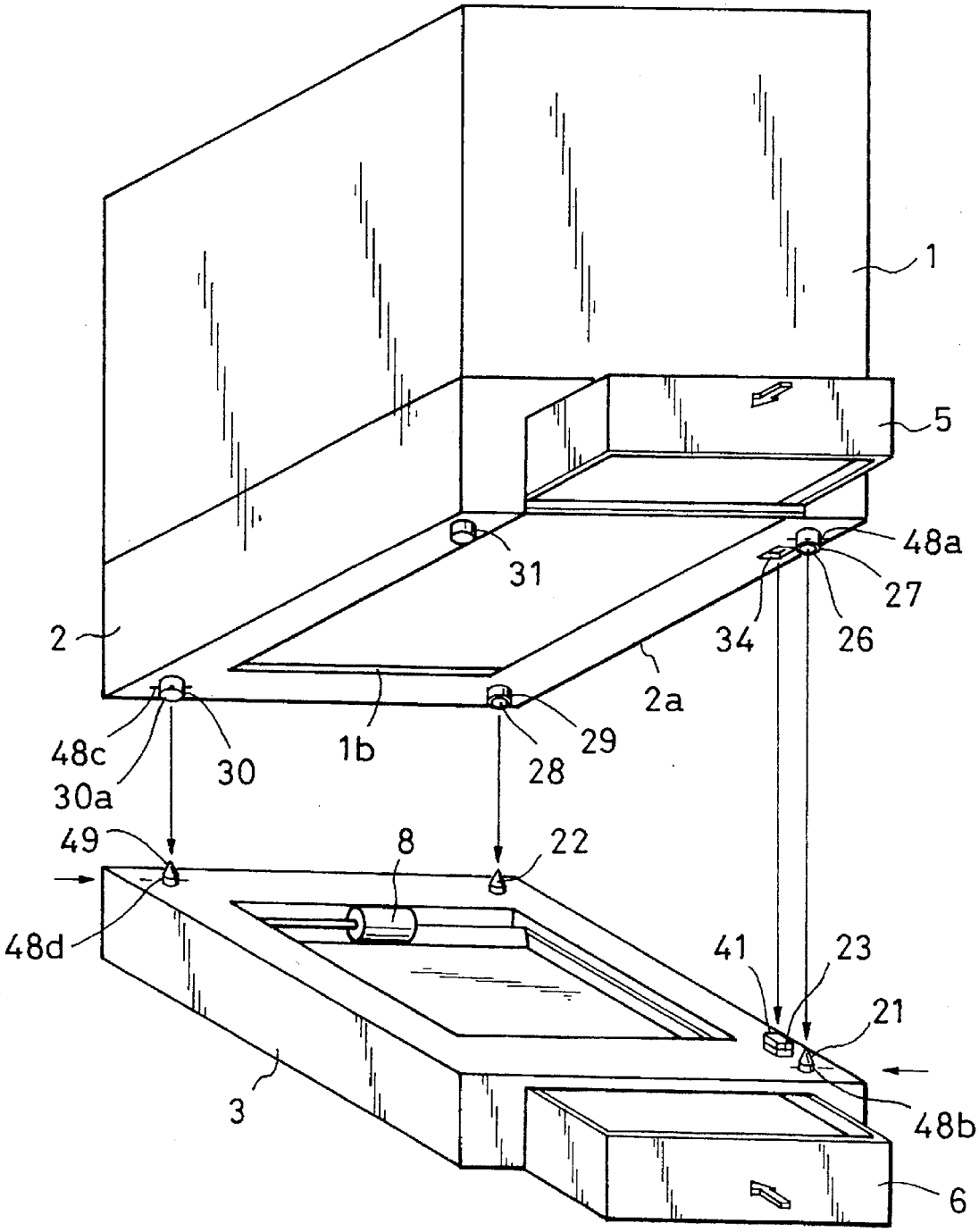
FIG. 7 is a perspective view illustrating the structure connecting an optional cassette feeder unit to the body of an image forming apparatus according to a third embodiment.
Figure 8A:
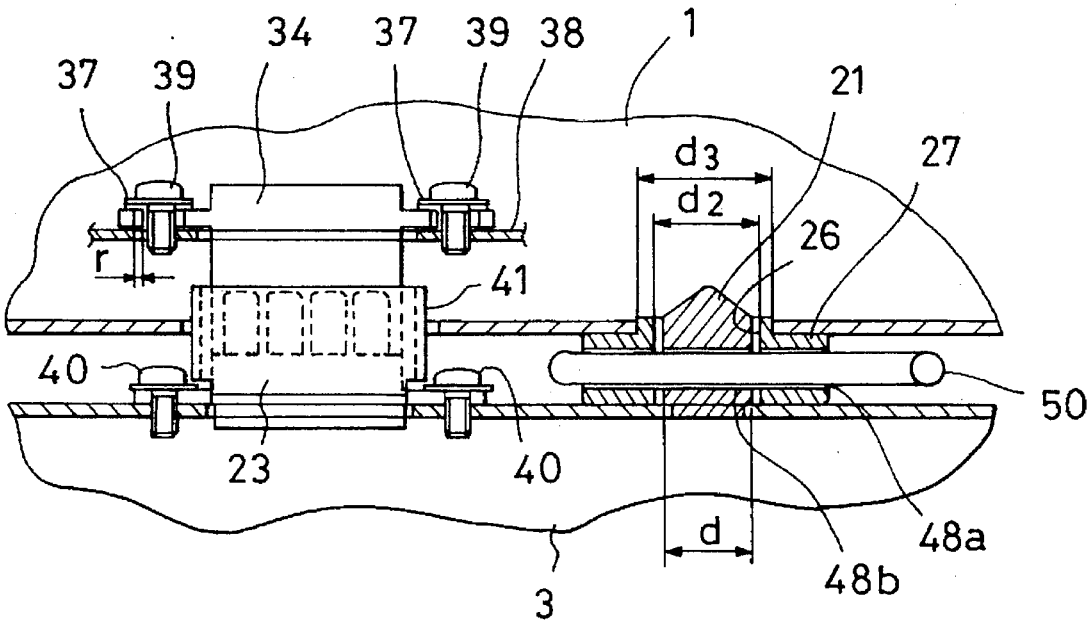
FIGS. 8(*a*) and 8(*b*) are a cross section and plane view, respectively, showing the connection structure between a leg section and a securing pin according to the third embodiment.
Figure 8B:
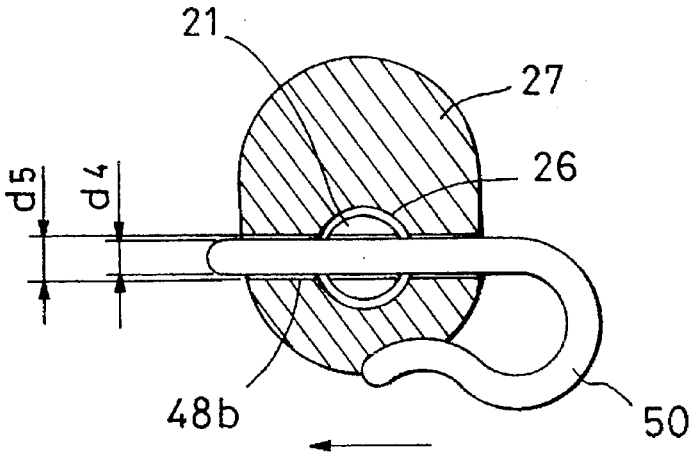

A third embodiment of the image forming apparatus according to the present invention will be described below with FIGS. 7 and 8. The same members as those used in the first embodiment are assigned the same symbols and their descriptions are omitted here. In FIGS. 7 and 8, a through hole 48*a* is formed at a leg 27 in the body 1 and another through hole 48*b* is formed at a positioning pin 21 in an optional cassette feeder unit 3 opposing the body 1.

A leg 30 and a positioning pin 49 disposed at the corner diagonal to the corner where the through holes 48*a* and 48*b* are disposed have through holes 48*c* and 48*d*, respectively.

At the leg 30, a positioning hole 30*a* for fitting with the positioning pin 49 is formed. The outside diameter of the positioning pin 49 is made larger than the inside diameter of the positioning hole 30*a*. The body 1 and the optional cassette feeder unit 3 are positioned with the positioning pins 21 and 22.

After the body 1 is mounted by fitting the positioning pins 21, 22, and 49 of the optional cassette feeder unit 3 with the positioning holes 26, 28, and 30*a* of the legs 27, 29, 30, securing pins 50, illustrated in FIGS. 8(*a*) and 8(*b*), are inserted into the through holes 48*a* and 48*b*, which are connected in the leg 27 and the positioning pin 21, and into the through holes 48*c* and 48*d*, which are connected in the leg 30 and the positioning pin 49 disposed at the corner diagonal to the corner where the leg 27 and the positioning pin 21 are disposed, in the directions shown in FIGS. 7 and 8(*b*) to connect the body 1 and the optional cassette feeder unit 3.

The securing pin 50 has an S-like shape and is elastic, giving better operability and an audible click when it is fit in the legs 27 and 30. Other configurations are the same as in the first embodiment, achieving the same advantages. The positioning holes may have shapes similar to those of the positioning holes used for the first embodiment.

Figure 9A:
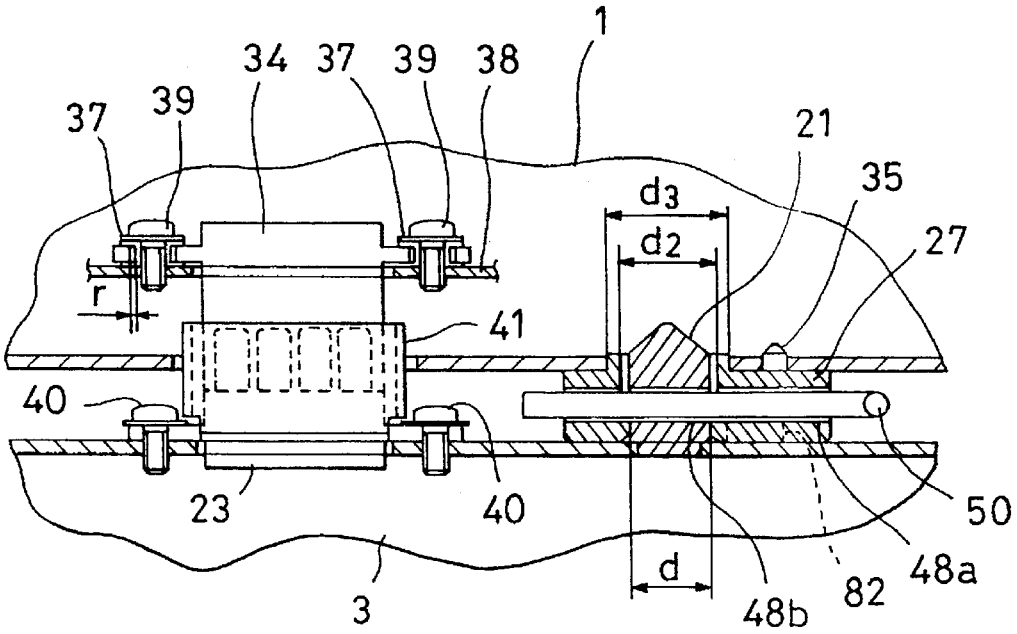
FIGS. 9(*a*) and 9(*b*) are a cross section and plane view, respectively, showing the connection structure between a leg section and a securing pin according to a fourth embodiment.
Figure 9B:
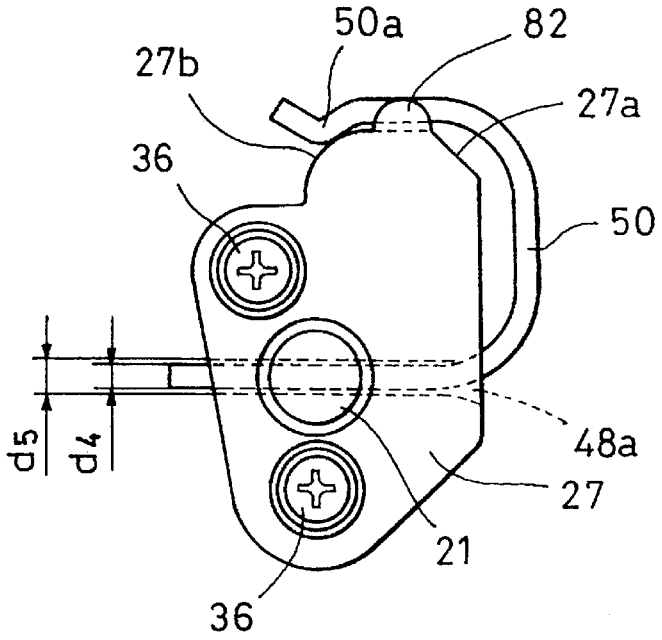
Figure 10:
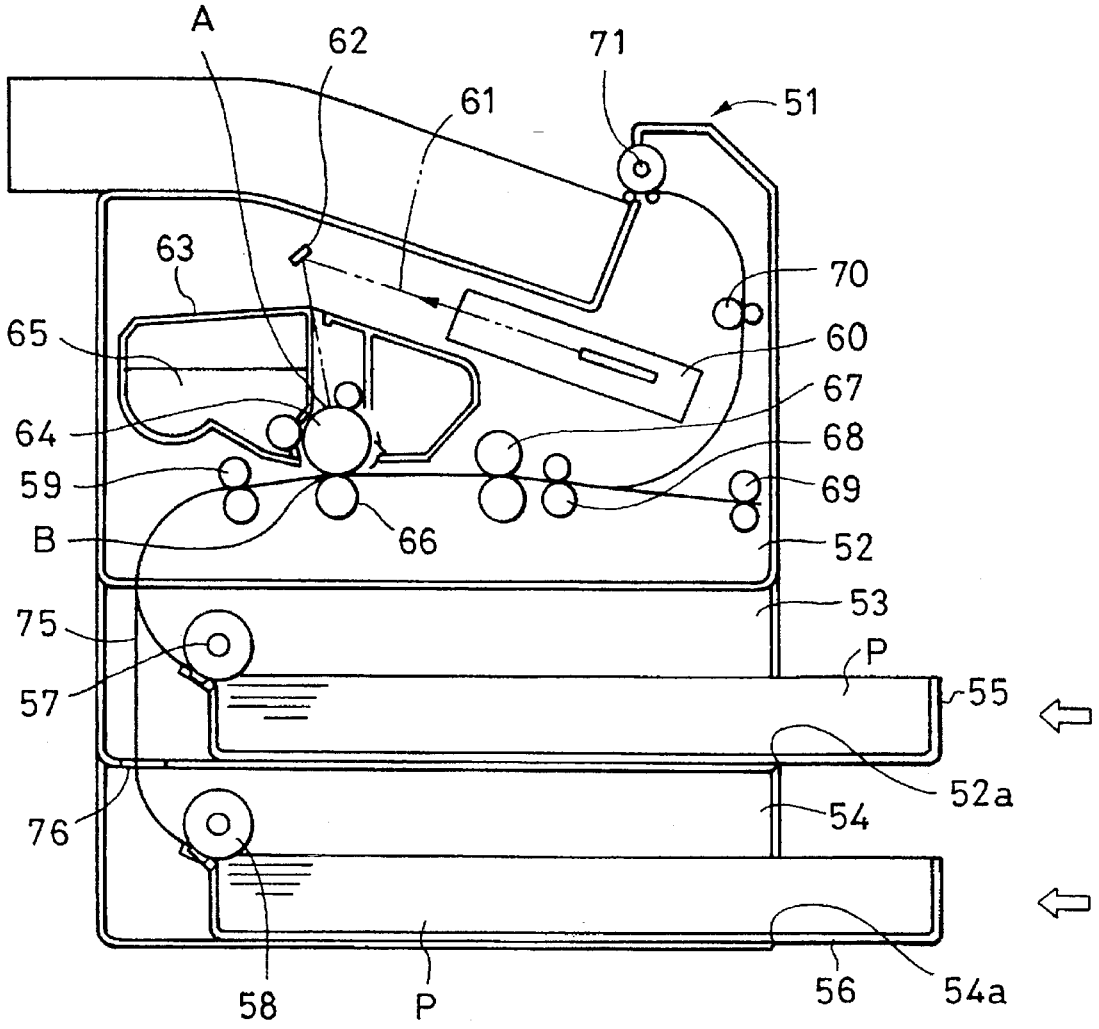
FIG. 10 PRIOR ART
FIG. 10 is a cross section illustrating the configuration of a conventional laser beam printer.
Figure 11:
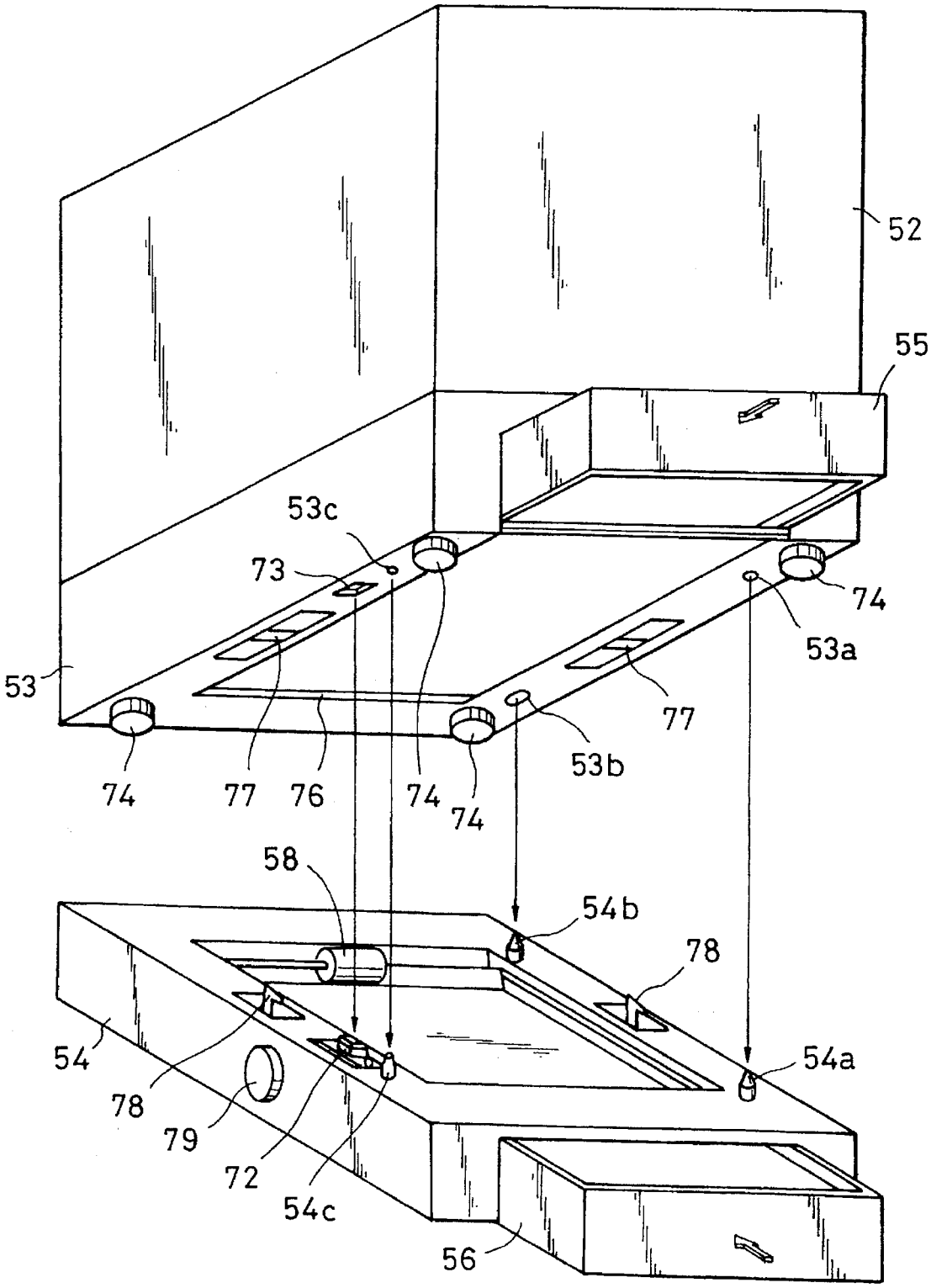
FIG. 11 PRIOR ART
FIG. 11 is a perspective view showing the connection structure of the conventional apparatus body and the conventional optional cassette feeder unit.
Figure 12A:
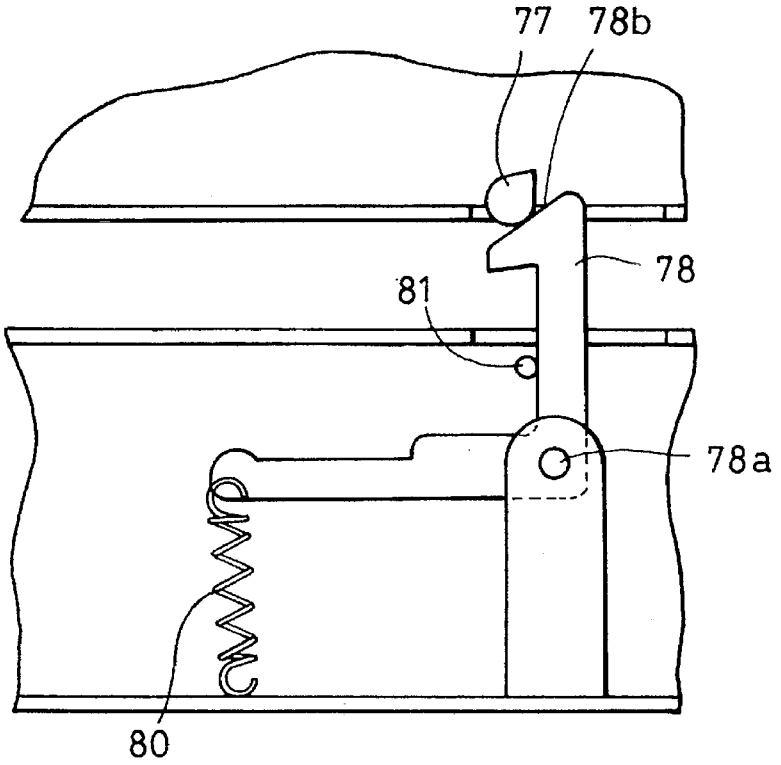
FIG. 12(a) PRIOR ART
FIGS. 12(*a*) and 12(*b*) are views showing operation of a locking mechanism for locking the conventional apparatus body and optional cassette feeder unit.
Figure 12B:
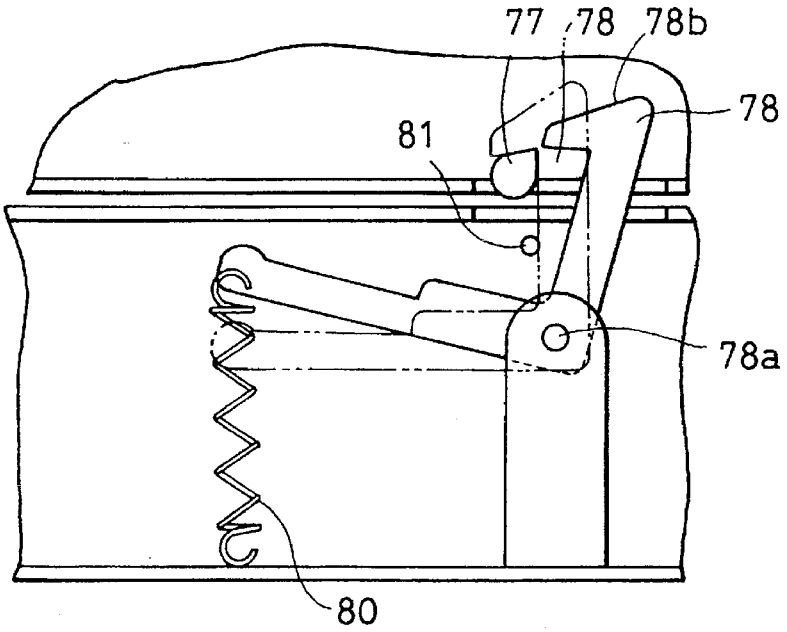
FIG. 12(b) PRIOR ART

A fourth embodiment according to the image forming apparatus of the present invention will be described below with reference to FIG. 9. The same members as those used in the first and third embodiments are assigned the same symbols and their descriptions are omitted here. FIG. 9 shows an outline of the fourth embodiment in which a securing pin is used as a locking mechanism. In FIG. 9, the securing pin 50 is made of an elastic material such as SUS304-WPB. It has a snap-fit type positioning and securing function with a tip portion 50*a* of the securing pin 50 being inserted beyond a taper portion 27*a* of a leg 27 as shown in FIG. 9(*b*) and being taken out through a curve portion 27*b* of the leg 27. A leg 30 is also configured in the same way.

Since a though hole 48*a* of the leg 27, a though hole 48*c* of a leg 30, a through hole 48*b* of a positioning pin 21, and a through hole 48*d* of a positioning pin 49 have the diameter $d_5$ which is larger than the diameter $d_4$ of the securing pin 50 by about 0.5 to 2 mm, the securing pin 50 can be inserted or taken out even if the through holes slightly shift with each other.

As shown in FIG. 9(*b*), in order for play caused by difference in diameter of $d_4$ and $d_5$ when the securing pin 50 is fully inserted, difference in snap fitting caused by dimension difference, and maintenance of elasticity of the securing pin 50 is a curve surface having a large radius is provided at the securing pin 50 and the through hole 48*a* of the leg 27.

At the outside peripheral of the leg 27, a protrusion 82 serving as rotation-Stop means for preventing the securing pin 50 from rotating in the through hole 48*a* is provided at a section lower than the through hole 48*a* as shown in FIG. 9(*b*). The protrusion 82 supports the lower part of the securing pin 50 so that the securing pin 50 does not rotate around the through holes 48*a*. The leg 30 is also configured in the same way.

This configuration prevents the securing pin 50 from dropping even when an opening and closing section is opened and space is formed under the leg 27. (The leg 27 is disposed near the opening and closing section of the optional cassette feeder unit 3.)

Other configurations are the same as for the first and third embodiments, obtaining the same advantages. As described above, the securing pin 50 is used for connecting and securing the body 1 to the optional cassette feeder unit 3 as a substitute for the slide locking plates 24 and 25 in the first and second embodiments, also providing a low-cost-locking mechanism in a narrow space.

In this embodiment, both legs 27 and 30 are provided with the protrusions 82 as shown in FIG. 9 and the securing pin 50 shown in FIG. 9 is used for engagement. The securing pin 50 used in the third embodiment shown in FIG. 8 may be used for the leg 30 with the securing pin 50 used in the fourth embodiment shown in FIG. 9 being used for the leg 27.

In the above-described embodiments, the image forming apparatus according to the present invention is applied to a laser beam printer. These embodiments do not limit applications of the apparatus. The apparatus may be applied to other systems, such as copying machines and facsimile machines.

With the above-described configuration and operation, the present invention uses simple locking means to connect the body to the feeder unit, allowing the body to be compact. It also eliminates highly precise machining of each member and highly precise assembly, both of which are required for a conventional apparatus, enabling the cost to be reduced.

When the positioning holes are formed at the legs provided at the bottom of the body in order to fit with the positioning pins provided for the feeder unit, the protrusion of the positioning pins and the floating connectors provided at the upper surface of the feeder unit can be reduced and the body can be roughly positioned to the feeder unit using the legs for mounting the body on the feeder unit, facilitating the mounting without the positioning pins and the floating connectors hitting other members.

Since the above-described positioning holes fit with the positioning pins at the leg bottom portion and leave space for them at the leg top portion, the positioning pins do not catch with the positioning holes even if the body is mounted on the feeder unit or removed from it with the body being slanted. This facilitates mounting and removing of the body on and from the feeder unit.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus comprising:

an apparatus body, said body including image forming means for forming an image on a sheet and having leg sections on a bottom surface thereof;

a feeder unit detachably mounted under said apparatus body and storing sheets for supply to said image forming means;

positioning means for positioning said apparatus body against said feeder unit, said positioning means comprising positioning holes provided on said leg sections and positioning pins provided on said feeder unit, and wherein said apparatus body is aligned with said feeder unit by fitting said positioning pins in the positioning holes;

locking means for connecting said apparatus body to said feeder unit, said locking means comprising through holes passing through said leg sections and said positioning pins, and securing pins insertable into said through holes for connecting said apparatus body to said feeder unit; and rotation-preventing means for preventing said securing pins from rotating in said through holes.

2. An image forming apparatus according to claim 1, wherein said securing pins are secured in said through holes by a snap-fitting mechanism.

3. An image forming apparatus according to claim 1, wherein said positioning holes are formed at a bottom surface of said leg sections.

4. An image forming apparatus according to claim 1, further comprising:

positioning holes formed at a bottom surface of said leg sections; and positioning pins provided on said feeder unit for fitting in said positioning holes, wherein said positioning holes are of a shape such that said positioning pins fit in said positioning holes at the bottom side of said leg sections and said positioning pins are loose at the inside of said leg sections.

5. An image forming apparatus according to claim 1, wherein said feeder unit is provided with a detachable sheet-supply cassette which stores sheets and sheet-feeding means for feeding sheets stored in said sheet-supply cassette.

6. An image forming apparatus according to claim 1, wherein said leg sections are disposed at each corner of said apparatus body and said locking means are provided at diagonally disposed corners.

7. An image forming apparatus according to claim 1, further comprising floating connectors for transferring electrical signals between said apparatus body and said feeder unit.

8. An image forming apparatus according to claim 7, wherein said floating connectors are disposed between the bottom surface of said leg sections of said apparatus body and the upper surface of said feeder unit.

9. An image forming apparatus comprising:

an apparatus body, said body including image forming means for forming an image on a sheet and having leg sections on a bottom surface thereof;

a feeder unit detachably mounted under said apparatus body and storing sheets for supply to said image forming means;

locking means for connecting said apparatus body and said feeder unit, said locking means comprising through holes passing through said leg sections, protrusive members provided on said feeder unit and securing pins insertable into said through holes for connecting said apparatus body to said feeder unit; and rotation-preventing means for preventing said securing pins from rotating in said through holes.

10. An image forming apparatus according to claim 9, wherein said securing pins are U-shaped members having an insert portion and a tip portion, said rotation-preventing means is a protrusion provided on said leg section, and said tip portion is connected with said protrusion for preventing said securing pins from rotating.

11. An image forming apparatus according to claim 10, wherein said U-shaped members are made of an elastic material, and said tip portions of said U-shaped members engage with said leg section by a snap-fit mechanism.

12. An image forming apparatus comprising:

an apparatus body, said body including image forming means for forming an image on a sheet and having leg sections on a bottom surface thereof;

a feeder unit detachably mounted under said apparatus body and storing sheets for supply to said image forming means;

locking means for connecting said-apparatus body and said feeder unit; and floating connectors for transferring an electrical signal between said apparatus body and said feeder unit, said floating connectors being disposed between the bottom surface of said leg section of said apparatus body and an upper surface of said feeder unit.

13. An image forming apparatus according to claim 12, wherein said feeder unit is provided with a detachable sheet-supply cassette which stores sheets and sheet-feeding means for feeding sheets stored in said sheet-supply cassette.

14. An image forming apparatus comprising:

an apparatus body, said body including image forming means for forming an image on a sheet;

a feeder unit detachably mounted under said apparatus body and storing sheets for supply to said image forming means;

positioning means for positioning said apparatus body against said feeder unit, said positioning means comprising first positioning members protruded from an underside of said apparatus body and second positioning members protruded from an upperside of said feeder unit, wherein said feeder unit is positioned to said apparatus body by engaging said first and second positioning members;

locking means for connecting said apparatus body and said feeder unit, said locking means comprising through holes passing through said first and second positioning members and securing pins insertable into said through holes; and rotation-prevention means for preventing said securing pins from rotating in said through holes.

* * * * *

UNITED STATES PATENT AND TRADEMARK OFFICE

CERTIFICATE OF CORRECTION

PATENT NO. : 5,666,595
DATED : September 9, 1997
INVENTOR(S) : Takao SAMESHIMA, et al.

It is certified that error appears in the above-identified patent and that said Letters Patent is hereby corrected as shown below:

Column 9

Line 39, delete "though" (both occurrences), and insert therefor --through--;
Line 50, after "50", insert a comma (","); and delete "is" (first occurrence);
Line 53, delete "rotation-Stop" and insert therefor --rotation-stop--.

Column 10

Line 3, delete the dash ("-") between "cost" and "locking".

Signed and Sealed this

Tenth Day of March, 1998

*Attest:*

Bruce Lehman

BRUCE LEHMAN

*Attesting Officer*

*Commissioner of Patents and Trademarks*